US012246939B2

(12) United States Patent
Shibata et al.

(10) Patent No.: US 12,246,939 B2
(45) Date of Patent: Mar. 11, 2025

(54) MEDIUM FEEDING DEVICE

(71) Applicant: RISO KAGAKU CORPORATION, Tokyo (JP)

(72) Inventors: Ryuichi Shibata, Tokyo (JP); Yoshifumi Noguchi, Tokyo (JP); Masashi Hara, Tokyo (JP)

(73) Assignee: RISO KAGAKU CORPORATION, Tokyo (JP)

( * ) Notice: Subject to any disclaimer, the term of this patent is extended or adjusted under 35 U.S.C. 154(b) by 108 days.

(21) Appl. No.: 18/118,204

(22) Filed: Mar. 7, 2023

(65) Prior Publication Data

US 2023/0312287 A1 Oct. 5, 2023

(30) Foreign Application Priority Data

Mar. 16, 2022 (JP) ..... 2022-041057

(51) Int. Cl.
*B65H 3/52* (2006.01)
*B65H 3/06* (2006.01)
*B65H 7/06* (2006.01)

(52) U.S. Cl.
CPC ..... *B65H 3/5223* (2013.01); *B65H 3/06* (2013.01); *B65H 7/06* (2013.01); *B65H 2511/20* (2013.01); *B65H 2511/414* (2013.01); *B65H 2511/524* (2013.01); *B65H 2513/10* (2013.01); *B65H 2513/20* (2013.01); *B65H 2513/50* (2013.01); *B65H 2513/52* (2013.01); *B65H 2801/06* (2013.01)

(58) Field of Classification Search
CPC ..... B65H 3/5223; B65H 7/06; B65H 2513/50
See application file for complete search history.

(56) References Cited

U.S. PATENT DOCUMENTS 6,508,465 B1 * 1/2003 Endo ..... B65H 3/5223 271/265.04

FOREIGN PATENT DOCUMENTS

JP 2018-76155 A 5/2018

* cited by examiner

*Primary Examiner* — Jeremy R Severson
(74) *Attorney, Agent, or Firm* — GREENBLUM & BERNSTEIN P.L.C

(57) ABSTRACT

A medium feeding device includes a feeder that feeds a medium, a medium detection sensor that detects the medium fed by the feeder, and a processor that changes feed settings of the feeder based on a detection result of the medium detection sensor, wherein the processor switches a feed setting to be changed among a plurality of the feed settings of the feeder based on the detection result of the medium detection sensor.

6 Claims, 19 Drawing Sheets

| CONDITIONS FOR CAUSING MULTI-FEED/BLANK FEED | |
|---|---|
| CONDITIONS AFFECTING PAPER FEED PERFORMANCE | ERROR CONTENT EXPECTED TO OCCUR |
| SEPARATION BOARD WEAR | MULTI-FEED |
| PAPER FEED ROLLER WEAR | MULTI-FEED |
| PAPER DUST ACCUMULATION | BLANK FEED/ MULTI-FEED |
| PAPER LOADING POSITION (ON REAR END SIDE) | BLANK FEED |
| PAPER LOADING POSITION (ON TOP END SIDE) | MULTI-FEED |
| PAPER LOADING POSITION (SIDE FENCES ARE INSTALLED NARROWER THAN SPECIFIED) | BLANK FEED |
| PAPER LOADING POSITION (SIDE FENCES ARE INSTALLED WIDER THAN SPECIFIED) | MULTI-FEED |
| PAPER QUALITY | BLANK FEED/ MULTI-FEED |

FIG. 8

| PRIORITIES | PAPER FEED SETTINGS TO BE CHANGED | BLANK FEED TENDENCY | MULTI-FEED TENDENCY |
|---|---|---|---|
| (1) | SEPARATION PRESSURE | CHANGE TO LOWER | CHANGE TO HIGHER |
| (2) | SEPARATION ANGLE | CHANGE TO - DIRECTION | CHANGE TO + DIRECTION |
| (3) | PAPER FEED ACCELERATION | ACCELERATE | DECELERATE |
| (4) | PAPER FEED DECELERATION | ACCELERATE | DECELERATE |
| (5) | PAPER FEED START TIMING | ADVANCED | DELAYED |
| (6) | SLACK AMOUNT | MORE | LESS |
| (7) | PAPER FEED SPEED | FAST | SLOW |
| (8) | PAPER UPPER LIMIT POSITION | UP | DOWN |

FIG. 9

| NUMBER OF FED SHEETS | DETECTION TIME[ms] | REFERENCE DETECTION TIME[ms] | DIFFERENCE TIME[ms] | BLANK FEED/ MULTI-FEED | PAPER FEED SETTING |
|---|---|---|---|---|---|
| 1 | 50 | 50 | 0 | | |
| 2 | 50 | 50 | 0 | | |
| 3 | 55 | 50 | 5 | BLANK FEED TENDENCY | CHANGE |
| 4 | 45 | 50 | -5 | MULTI-FEED TENDENCY | CHANGE |
| 5 | 50 | 50 | 0 | | |
| 6 | 50 | 50 | 0 | | |
| 7 | 50 | 50 | 0 | | |
| 8 | 40 | 50 | -10 | MULTI-FEED TENDENCY | CHANGE |
| 9 | 50 | 50 | 0 | | |
| 10 | 50 | 50 | 0 | | |

FIG. 14

| NUMBER OF FED SHEETS | DETECTION TIME[ms] | REFERENCE DETECTION TIME[ms] | DIFFERENCE TIME[ms] | NUMBER OF COUNTS OF ±5ms OR MORE |
|---|---|---|---|---|
| 1 | 50 | 50 | 0 | |
| 2 | 52 | 50 | 2 | |
| 3 | 56 | 50 | 6 | 1 |
| 4 | 57 | 50 | 7 | 2 |
| 5 | 58 | 50 | 8 | 3 |
| 6 | 52 | 50 | 2 | |
| 7 | 56 | 50 | 7 | 4 |
| 8 | 52 | 50 | 2 | |
| 9 | 50 | 50 | 0 | |
| 10 | 51 | 50 | 1 | |

FIG. 15

MEDIUM FEEDING DEVICE

CROSS-REFERENCES

This application is based upon and claims the benefit of priority of the prior Japanese Patent Application No. 2022-041057 filed on Mar. 16, 2022, the entire contents of which are incorporated herein by reference.

FIELD

The embodiments discussed herein are related to a medium feeding device that feeds media.

BACKGROUND

Conventionally, in order to overcome paper skew caused due to diagonal feeding of paper in a conveyance process or in order to synchronize a print start position on a printing paper and a print start position of a print unit, there is known a paper feeding device that abuts the tip of a fed paper against a resist roller pair to stop once for generating slack, and conveys the paper toward the print unit at a prescribed timing.

In such a paper feeding device, there is proposed a paper feeding device that: determines whether there is a single or a plurality of sheets of paper to be conveyed based on a load current of a paper feed pickup roller; and, when there are a plurality of sheets to be conveyed, drives the paper feed pickup roller at a slower speed than a case of conveying a single sheet (see Japanese Patent Laid-Open No. 2018-076155, for example).

SUMMARY

According to one aspect, a medium feeding device includes: a feeder that feeds a medium; a medium detection sensor that detects the medium fed by the feeder; and a processor that changes feed settings of the feeder based on a detection result of the medium detection sensor, wherein the processor switches a feed setting to be changed among a plurality of the feed settings of the feeder based on the detection result of the medium detection sensor.

The object and advantages of the present invention may be realized by the elements and their combinations described in the claims.

BRIEF DESCRIPTION OF THE DRAWINGS

FIG. 8 is a table for describing examples of conditions under which multi-feed/blank feed occur in the embodiment.

FIG. 9 is a table for describing examples of the priorities when switching the paper feed settings and changing content of the paper feed settings when there is occurrence of multi-feed/blank feed in the embodiment.

FIG. 14 is a table for describing detection examples of blank feed/multi-feed according to the embodiment.

FIG. 15 is a table for describing other detection examples of blank feed/multi-feed according to the embodiment.

DESCRIPTION OF EMBODIMENTS

However, with a print device, multi-feed and blank feed may occur when feeding the paper.

When multi-feed occurs, the following are caused: a blank sheet is included in discharged sheets of paper, so that the order of pages changes; the sheets of paper get stacked thick, so that the sheets of paper come in contact with the print unit such as an inkjet head, thereby damaging the print unit and smudging the conveyed paper; or the printing action stops, so that work of clearing paper jam and clearing error needs to be performed, which results in deteriorating the paper feeding efficiency (productivity).

On the other hand, when blank feed occurs, paper feed becomes slow. Therefore, slack of the paper to be generated by abutting against the resist roller pair is not formed sufficiently or it takes time for feeding a sheet of paper, which results in deteriorating the paper feeding efficiency (productivity).

For example, there may be a case where multi-feed can be suppressed by slowing down the conveyance speed of the paper feed pickup roller (paper feeding unit) like the paper feeding device described above. Furthermore, there may be a case where blank feed can be suppressed by increasing the conveyance speed. However, ease of solving multi-feed and blank feed varies even when paper feed settings are changed depending on the deteriorated level of each member of the paper feeding unit, loaded position of the paper on a tray, and the like. Thus, multi-feed and blank feed should not surely be solved by simply changing a specific paper feed setting (conveyance speed) every time.

Hereinafter, a medium feeding device according to an embodiment of the present invention will be described with reference to the accompanying drawings.

Figure 1:
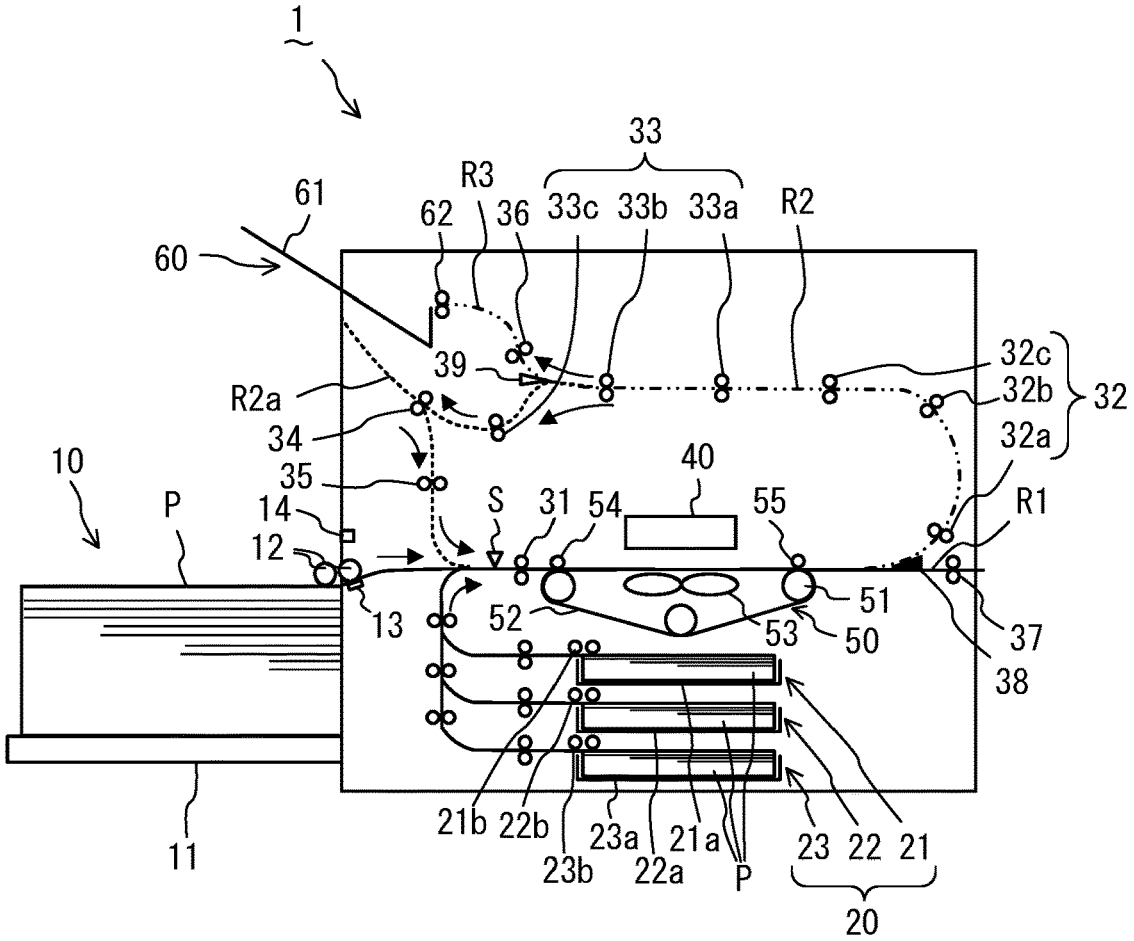
FIG. 1 is a diagram showing an internal structure of a print device according to an embodiment.

FIG. 1 is a diagram showing an internal structure of a print device 1 according to the embodiment.

Figure 2:
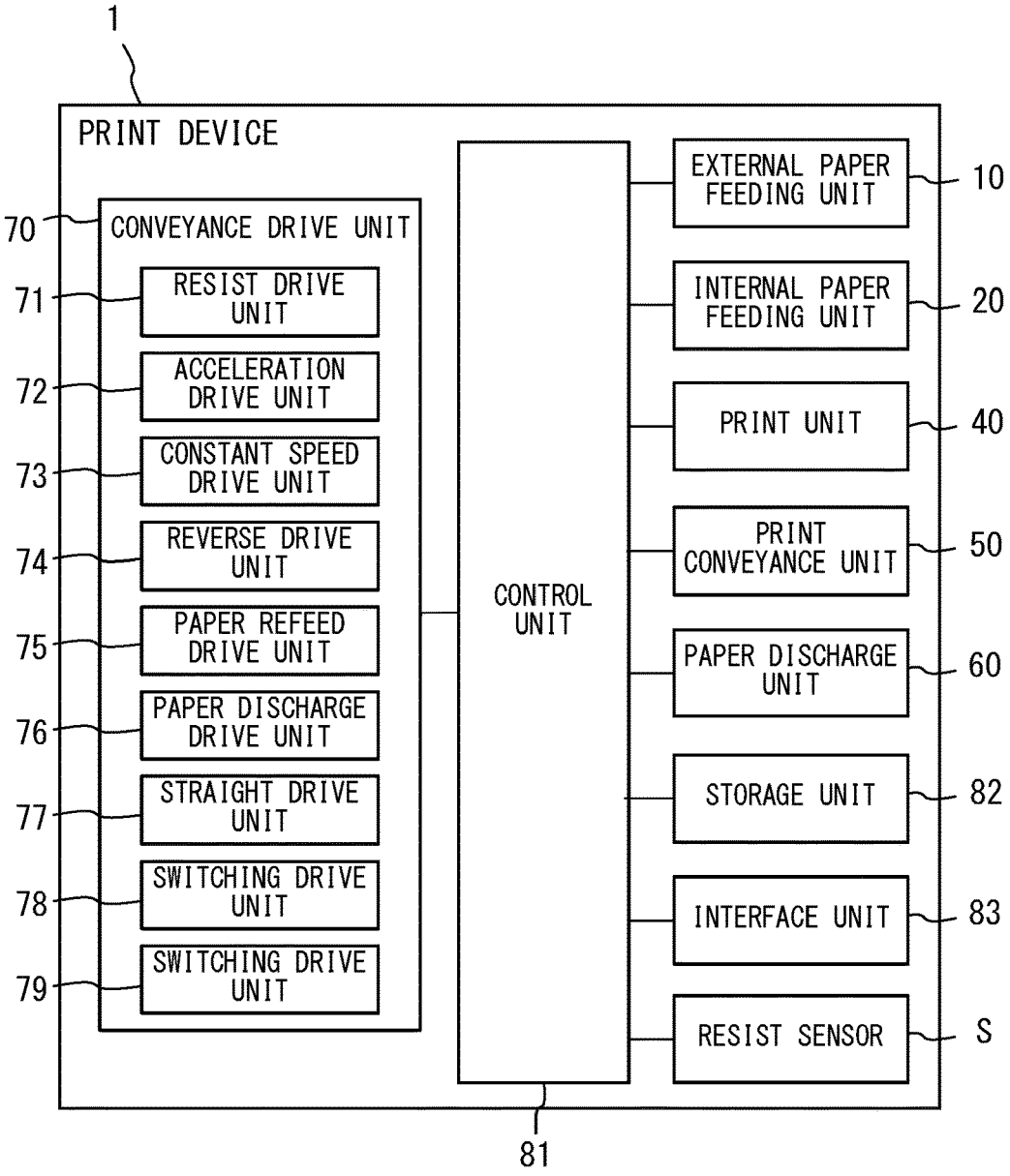
FIG. 2 is a diagram showing a control configuration of the print device according to the embodiment.

FIG. 2 is a diagram showing a control configuration of the print device 1.

As shown in FIG. 1 and FIG. 2, the print device 1 includes an external paper feeding unit 10, an internal paper feeding unit 20, a print unit 40, a print conveyance unit 50, a paper discharge unit 60, and a resist sensor S. Furthermore, as shown in FIG. 1, the print device 1 includes a resist roller pair 31, an acceleration conveyance unit 32, a constant speed conveyance unit 33, a reverse conveyance unit 34, a paper refeeding unit 35, a paper discharge conveyance unit 36, a straight conveyance unit 37, and route switching units 38, 39. Moreover, as shown in FIG. 2, the print device 1 includes a conveyance drive unit 70, a control unit 81, a storage unit 82, and an interface unit 83.

Note that paper P in the embodiment is an example of media, and the media may also be those of sheet types formed with a material other than paper, those having folded part such as envelopes, and the like. Accordingly, in the present Description, paper feed is an example of feeding, and paper discharge is an example of discharging. Therefore, paper feed can be replaced with feed (for example, paper refeeding unit may be replaced with refeeding unit), paper discharge may be replaced with discharge, and the paper may be replaced with media.

In FIG. 1, a straight conveyance route R1 of the paper P continued from the external paper feeding unit 10 or internal paper feeding unit 20 is indicated with a solid line, a route from a circulation conveyance route R2 for double-sided print located on the upper side of the print unit 40 continued to a paper discharge conveyance route R3 is indicated with an alternate long and two short dashes line, and a reverse conveyance route R2*a* of the circulation conveyance route R2 is indicated with a dotted line.

Figure 3:
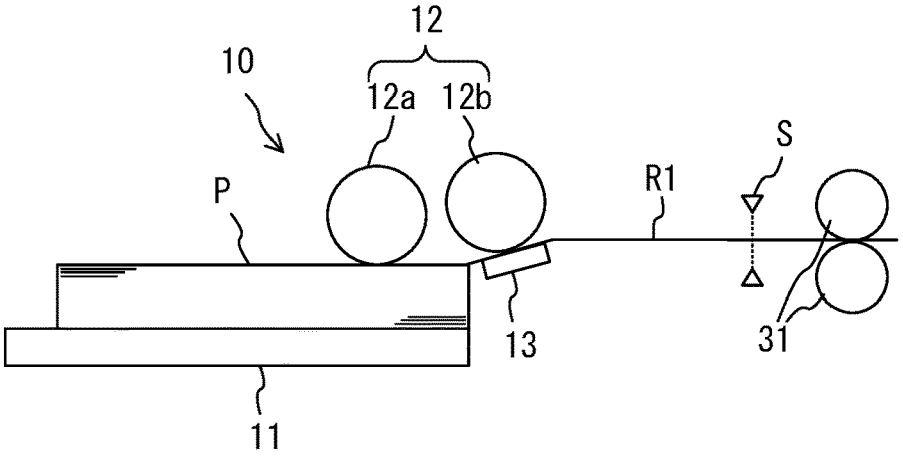
FIG. 3 is a diagram showing a configuration of an external paper feeding unit according to the embodiment.
Figure 4:
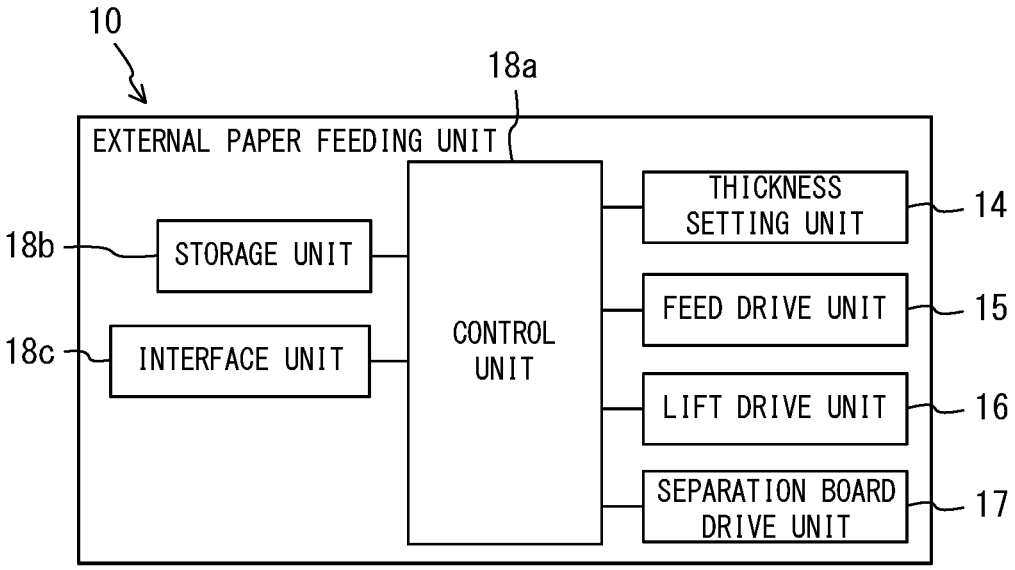
FIG. 4 is a diagram showing a control configuration of the external paper feeding unit according to the embodiment.

As shown in FIG. 1 and FIG. 3, the external paper feeding unit 10 includes a paper feed tray 11, a paper feed roller 12, and a separation board 13. Furthermore, as shown in FIG. 4, the external paper feeding unit 10 includes a thickness setting unit 14 (see FIG. 1), a feed drive unit 15, a lift drive unit 16, a separation board drive unit 17, a control unit 18*a*, a storage unit 18*b*, and an interface unit 18*c*. The external paper feeding unit 10 is disposed to be exposed to outside the print device 1, for example. Note that each of the units of the external paper feeding unit 10 except for the control unit 18*a*, the storage unit 18*b*, and the interface unit 18*c* functions as an example of the feeding unit (feeder) that feeds media. The medium feeding device according to the embodiment includes the feeding unit, the resist sensor S, and the control unit 18*a* (or a control unit 81 to be described later).

As shown in FIG. 3, the paper P before having printing thereon is loaded on the paper feed tray 11. Note that the paper feed tray 11 is an example of a tray on which the medium is loaded.

The paper feed roller 12 includes a scraper roller 12*a* and a pickup roller 12*b*, and sends out and conveys the paper P located on the uppermost position of a plurality of sheets of paper P loaded on the paper feed tray 11. Note that the paper feed roller 12 is an example of a feed member that sends out the medium.

The separation board 13 sandwiches the paper P with the pickup roller 12*b*, and separates the paper P by each sheet. Note that the separation board 13 is an example of a separation member that separates the medium by sandwiching it with the feed member (the paper feed roller 12).

In the thickness setting unit 14 shown in FIG. 1 and FIG. 4, the thickness of the paper P loaded on the paper feed tray 11 is set by a user. For example, the thickness setting unit 14 has a lever, a dial, or the like capable of moving to a position where "thick paper" is written indicating that the paper P is thick paper, a position where "regular paper" is written indicating that the paper P is regular paper, and a position where "thin paper" is written indicating that the paper P is thin paper. The control unit 18*a* to be described later acquires thickness information of the paper P set in the thickness setting unit 14. Note that the control unit 18*a* may acquire a print job and the thickness information of the paper P set by an operation panel or the like of the print device 1.

The feed drive unit 15 shown in FIG. 4 is an actuator such as a motor that drives the paper feed roller 12. In the embodiment, a case of adjustment of acceleration and conveyance speed of the external paper feeding unit 10 will be described. However, the acceleration and the conveyance speed are those of the feed drive unit 15, and acceleration and conveyance speed of the actually conveyed paper P may become smaller or slower than the value of the actuator due to slip and the like between the paper P and the paper feed roller 12.

The lift drive unit 16 is an actuator such as a motor that lifts up and down the paper feed tray 11.

Figure 12:
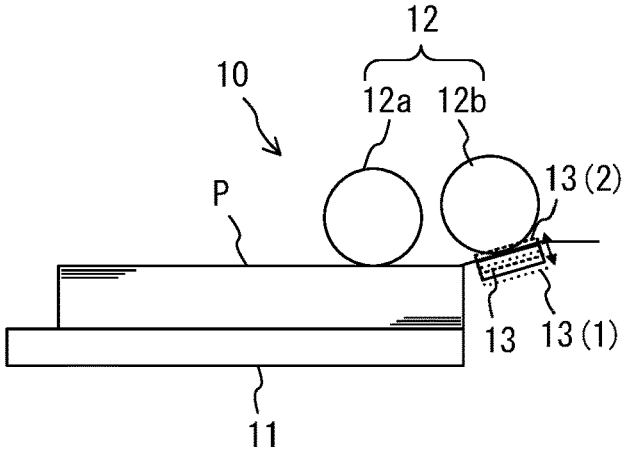
FIG. 12 is a diagram for describing a case of adjustment of separation angles of a separation board according to the embodiment.
Figure 13:
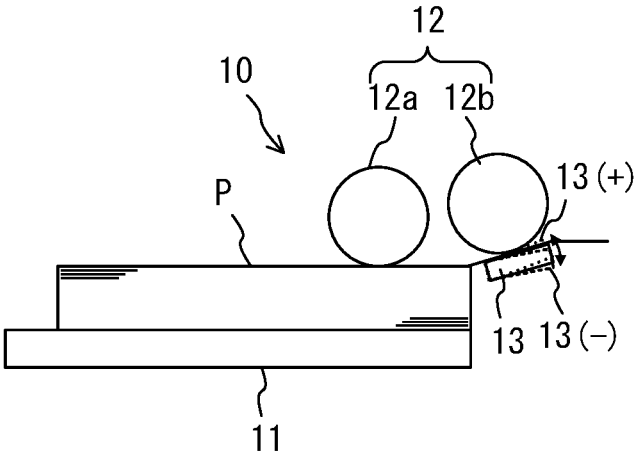
FIG. 13 is a diagram for describing a case of adjustment of separation pressures of the separation board according to the embodiment.

The separation board drive unit 17 is an actuator such as a motor that moves the separation board 13 to a direction leaving away from the pickup roller 12*b* (paper P) (see the separation board 13(1)) and to a direction approaching the pickup roller 12*b* (see the separation board 13(2)) as shown in FIG. 12 to be described later. Furthermore, the separation board drive unit 17 rotates the separation board 13 to a direction rising up toward the pickup roller 12*b* side (see the separation board 13(+)) and to a direction falling down to be away from the pickup roller 12*b* side (see the separation board 13(−)) as shown in FIG. 13 to be described later.

The control unit 18*a* includes a processor (for example, a CPU: Central Processing Unit) functioning as an arithmetic processing unit that controls the operations of the entire external paper feeding unit 10. While details thereof will be described later, the control unit 18*a* changes the paper feed setting (an example of feed setting) or switches the paper feed setting to be changed among a plurality of paper feed settings of the external paper feeding unit 10 based on a detection result of the resist sensor S. In a case where the medium feeding device including the external paper feeding unit 10 and the resist sensor S is disposed integrally with the print device 1 (feed destination device) as shown in FIG. 1, the control unit 81 that controls the operations of the entire print device 1 may functions as the control unit 18*a*.

The storage unit 18*b* includes, for example, memories such as a ROM (Read Only Memory) that is a read only semiconductor memory in which a prescribed control program is recorded in advance, and a RAM (Random Access Memory) that is a randomly writable and readable semiconductor memory used as a work memory area as necessary when the processor executes various kinds of control programs.

The interface unit 18*c* exchanges various kinds of information with external devices. For example, the interface unit 18*c* exchanges various kinds of information with the interface unit 83 and the like of the print device 1.

As shown in FIG. 1, the internal paper feeding unit 20 includes a first paper feeding unit 21, a second paper feeding unit 22, and a third paper feeding unit 23.

The first paper feeding unit 21, the second paper feeding unit 22, and the third paper feeding unit 23 are disposed inside the print device 1 in this order from the upper side. The first paper feeding unit 21, the second paper feeding unit 22, and the third paper feeding unit 23 each include: paper feed trays 21*a*, 22*a*, and 23*a* where the paper before having printing thereon is loaded; and paper feed rollers 21*b*, 22*b*, and 23*b* as examples of a feed member that sends out and conveys the paper P located on the uppermost side among a plurality of sheets of paper P loaded on the paper feed trays 21*a*, 22*a*, and 23*a*. Although not shown, actuators and the like, such as motors for driving the paper feed rollers 21*b*, 22*b*, and 23*b*, are also disposed in the internal paper feeding unit 20.

On the straight conveyance route R1 continued from the external paper feeding unit 10 or the internal paper feeding unit 20, the resist roller pair 31 is disposed on the upstream side of the conveyance direction of the print unit 40 and the print conveyance unit 50. Against the resist roller pair 31, the paper conveyed toward the print unit 40 from the external paper feeding unit 10, the internal paper feeding unit 20, or the paper refeeding unit 35 is abutted. Thereby, the resist roller pair 31 corrects the skew of the paper P, and conveys the paper P while nipping it. Considering the external paper feeding unit 10 as a primary feeding unit, the resist roller pair 31 functions as a secondary feeding unit that feeds the paper P fed by the primary feeding unit.

The acceleration conveyance unit 32 is capable of accelerated conveyance of the paper P on the circulation conveyance route R2. The acceleration conveyance unit 32 includes acceleration roller pairs 32*a*, 32*b*, and 32*c* that convey the paper P while nipping it.

The constant speed conveyance unit 33 performs constant speed conveyance of the paper P at a variable conveyance speed on the downstream side of the conveyance direction with respect to the acceleration conveyance unit 32 on the circulation conveyance route R2. The constant speed conveyance unit 33 includes constant speed roller pairs 33*a*, 33*b*, and 33*c* that convey the paper P while nipping it.

The reverse conveyance unit 34 is a switchback roller pair that reverses the front and back sides of the paper P by switchback-conveying the paper P while nipping it on a reverse conveyance route R2*a* provided on the downstream side of the conveyance direction with respect to the constant speed conveyance unit 33 on the circulation conveyance route R2.

The paper refeeding unit 35 is a paper refeed roller pair that refeeds the paper P toward the print unit 40 on the downstream side of the conveyance direction with respect to the constant speed conveyance unit 33 on the circulation conveyance route R2. The paper refeeding unit 35 conveys the paper P at a reduced speed when abutting the paper P against the resist roller pair 31.

The paper discharge conveyance unit 36 is a paper discharge roller pair that conveys the paper P while nipping it toward the paper discharge unit 60 on the paper discharge conveyance route R3 connected to the circulation conveyance route R2 on the upstream side of the conveyance direction with respect to the reverse conveyance route R2*a*.

The straight conveyance unit 37 is a straight roller pair that is disposed at the end part on the downstream side of the conveyance direction of the straight conveyance route R1 and conveys the paper P while nipping it toward a paper discharge unit, a conveyance unit, a postprocessing unit, or the like, not shown, connected to the print device 1.

The route switching unit 38 switches the conveyance route of the paper P on the straight conveyance route R1 where printing is done by the print unit 40 to the straight conveyance route R1 and the circulation conveyance route R2. The route switching unit 38 is a flipper, for example.

The route switching unit 39 switches the conveyance route of the paper P conveyed on the circulation conveyance route R2 to the reverse conveyance route R2*a* and the paper discharge conveyance route R3. The route switching unit 39 is a flipper, for example.

The print unit 40 includes, for example, line-head type inkjet heads, not shown, for each color used for printing. Note that the printing method of the print unit 40 may also be those other than the inkjet printing method.

The print conveyance unit 50 is disposed to oppose to the print unit 40, and conveys the paper P in the print unit 40. The print conveyance unit 50 includes: a plurality of pulleys 51; a belt 52 stretched over the pulleys 51; a suction fan 53 for making the paper P adsorbed to the belt 52 by sucking the air through a plurality of holes provided in the belt 52; a guide roller 54 disposed to oppose to the pulleys 51 at the end part on the upstream side of the conveyance direction of the print conveyance unit 50; and a guide roller 55 disposed to oppose to the pulleys 51 at the end part on the downstream side of the conveyance direction of the print conveyance unit 50. Note that the print conveyance unit 50 is not limited to the type that conveys the paper P while absorbing it.

The paper discharge unit 60 is disposed to be exposed to outside the print device 1. The paper discharge unit 60 includes: a paper discharge tray 61 on which the paper P after having printing thereon is loaded; and a paper discharge roller pair 62 that conveys the paper P toward the paper discharge tray 61.

On the straight conveyance route R1, the resist sensor S is disposed on the downstream side with respect to the external paper feeding unit 10 in the conveyance direction of the paper P and on the upstream side with respect to the resist roller pair 31. The resist sensor S detects the paper P fed by the external paper feeding unit 10 and the paper refeeding unit 35. Note that the resist sensor S is an example of a medium detection sensor that detects the paper P fed by the external paper feeding unit 10.

The conveyance drive unit 70 shown in FIG. 2 includes: a resist drive unit 71 that drives the resist roller pair 31; an acceleration drive unit 72 that drives the acceleration conveyance unit 32; a constant speed drive unit 73 that drives the constant speed conveyance unit 33; a reverse drive unit 74 that drives the reverse conveyance unit 34; a paper refeed drive unit 75 that drives the paper refeeding unit 35; a paper discharge drive unit 76 that drives the paper discharge conveyance unit 36; a straight drive unit 77 that drives the straight conveyance unit 37; and switching drive units 78, 79 that drive the route switching units 38, 39. Each of the drive units includes a single actuator or a plurality of actuators such as motors. Note that the single actuator may include a plurality of the drive units.

The control unit 81 includes a processor (for example, a CPU) functioning as an arithmetic processing device that controls operations of the entire print device 1. The control unit 81, instead of the control unit 18*a* of the external paper feeding unit 10 shown in FIG. 4, may change the paper feed setting of the external paper feeding unit 10 or switch the paper feed setting to be changed among a plurality of paper feed settings of the external paper feeding unit 10 based on the detection result of the resist sensor S.

The storage unit 82 includes: for example, memories such as a ROM that is a read only semiconductor memory in which a prescribed control program is recorded in advance, and a RAM (Random Access Memory) that is a randomly writable and readable semiconductor memory used as a work memory area as necessary when the processor executes various kinds of control programs; a hard disk device; and the like.

The interface unit 83 exchanges various kinds of information with the external devices. For example, the interface unit 83 receives a print job including print data from a user terminal, and exchanges various kinds of information with the interface unit 18*c* of the external paper feeding unit 10.

Next, blank feed and multi-feed of the paper P will be described with reference to FIG. 5 to FIG. 7.

Figure 5:
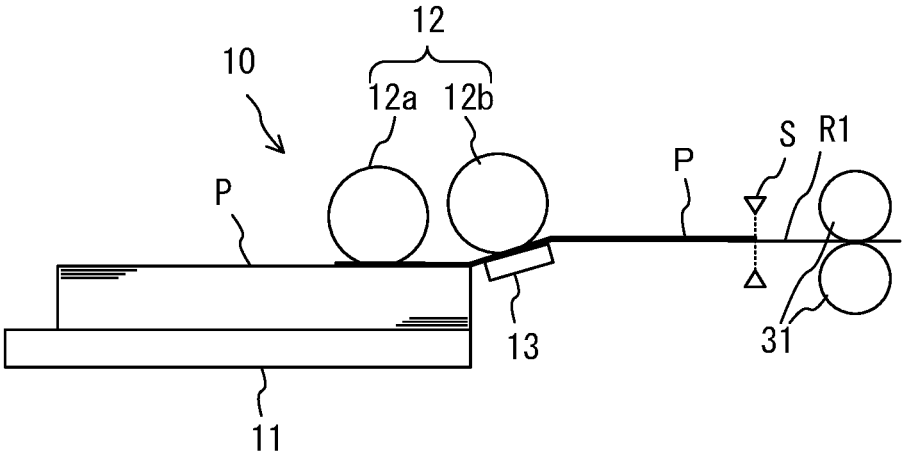
FIG. 5 is a diagram for describing a case of paper without blank feed and multi-feed after a passage of a reference detection time according to the embodiment.

First, when detection time from the start of feeding the paper P by the external paper feeding unit 10 (for example, when the control unit 18*a* transmits a start signal to the feed drive unit 15) to the detection of the paper P by the resist sensor S is the same as a reference detection time that is a theoretical value determined in advance, the tip of the paper P is detected by the resist sensor S as shown in FIG. 5 after a passage of the reference detection time from the start of feeding the paper P by the external paper feeding unit 10.

Figure 6:
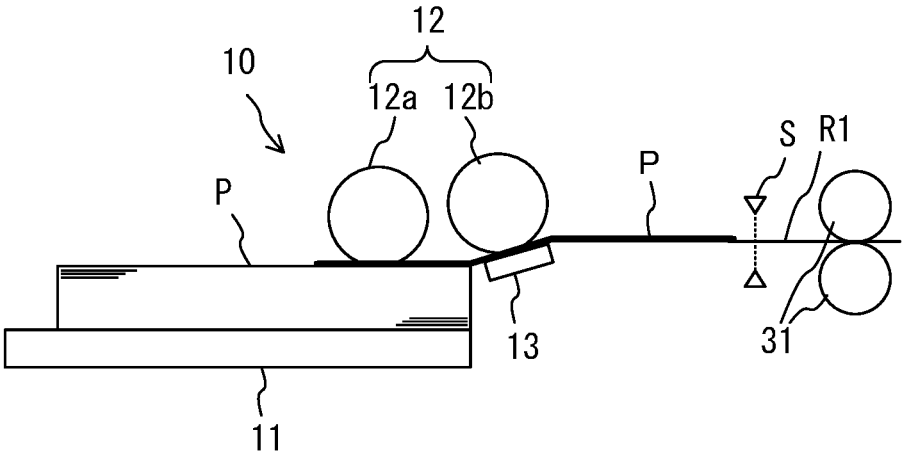
FIG. 6 is a diagram for describing a case of paper in a blank feed tendency after a passage of the reference detection time according to the embodiment.

Next, when the paper P tends to be blank-fed and feed of the paper P is delayed, even after a passage of the reference detection time from the start of feeding the paper P by the external paper feeding unit 10, the tip of the paper P does not reach the resist sensor S as shown in FIG. 6 and is not detected by the resist sensor S. That is, the detection time becomes longer than the reference detection time.

Figure 7:
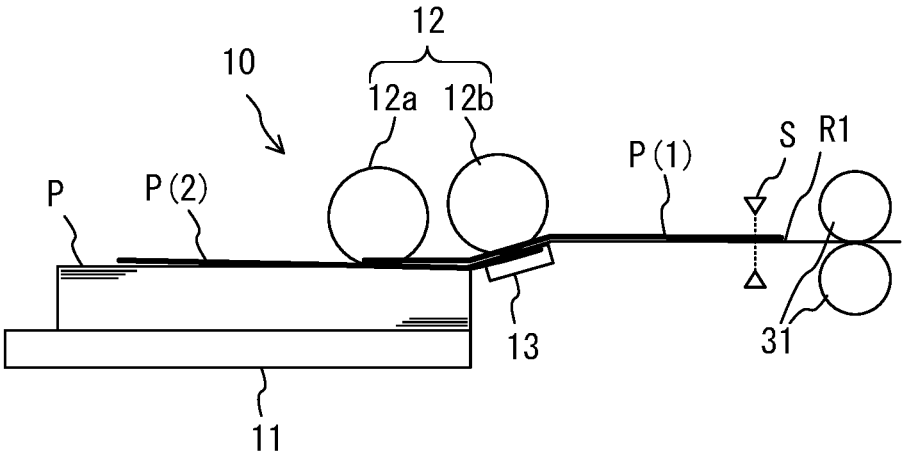
FIG. 7 is a diagram for describing a case of paper in a multi-feed tendency after a passage of the reference detection time according to the embodiment.

Next, when the paper P tends to be multi-fed and feed of the paper P is fast as in a case where the following paper P(2) is conveyed along with the feed of the prior paper P(1) as shown in FIG. 7, the tip of the paper P passes the resist sensor S after a passage of the reference detection time from the start of feeding the paper P by the external paper feeding unit 10, as shown in FIG. 7. That is, the detection time becomes shorter than the reference detection time.

The blank feed shown in FIG. 6 and the multi-feed shown in FIG. 7 are considered to be caused under conditions and the like shown in FIG. 8, for example. Note that blank feed tendency and multi-feed tendency refer to the state where blank feed or multi-feed is occurring to such an extent that causes no blank feed error or multi-feed error.

For example, when the separation board 13 and the pickup roller 12*b* (the paper feed roller 12) are worn out, the separation performance of the separation board 13 for the paper P is deteriorated. Therefore, multi-feed of the paper P tends to occur. Furthermore, when paper dust is accumulated on the paper feed roller 12, blank feed tends to occur due to slip between the paper P and the paper feed roller 12. When paper dust is accumulated on the separation board 13, the separation performance of the separation board 13 for the paper P is deteriorated. Therefore, multi-feed of the paper P tends to occur. Moreover, when the loading position of the paper P on the paper feed tray 11 is on the rear end side (on the upstream side of the conveyance direction), paper feed is delayed and blank feed tends to occur. When the loading position is on the top end side (on the downstream side of the conveyance direction), multi-feed tends to occur. Furthermore, when side fences, not shown, for restricting the position of the paper P on the paper feed tray 11 in the width direction of the conveyance direction are installed to be narrower in the width direction than specified, blank feed tends to occur due to friction between the paper P and the side fences. When the side fences are installed wider in the width direction than specified, multi-feed tends to occur since there is no friction between the paper P and the side fences. Furthermore, when the paper P has a paper quality that is not likely to cause friction, blank feed tends to occur. When the paper P is likely to cause friction, multi-feed tends to occur.

Upon detecting blank feed (blank feed tendency) and multi-feed (multi-feed tendency) of the paper P, the control unit 18*a* changes the paper feed settings shown in FIG. 9, for example, in order to solve blank feed and multi-feed. Although details are to be described later, the paper feed settings to be changed are switched in order of priorities from (1) to (8), for example, based on the detection result of the resist sensor S.

For example, in a case where the separation pressure of the separation board 13 is to be changed, when blank feed is being detected, the control unit 18*a* controls the separation board drive unit 17 to move the separation board 13 toward a direction away from the pickup roller 12*b* (the paper P) (see the separation board 13(1)) to lower the separation pressure, as shown in FIG. 12. On the other hand, when multi-feed is being detected, the control unit 18*a* controls the separation board drive unit 17 to move the separation board 13 toward a direction approaching the pickup roller 12*b* (the paper P) (see the separation board 13(2)) to increase the separation pressure.

Furthermore, in a case where the separation angle of the separation board 13 is to be changed, when blank feed is being detected, the control unit 18*a* controls the separation board drive unit 17 to rotate the separation board 13 toward a – direction away from and tilted from the pickup roller 12*b* (the paper P) side (see the separation board 13(–)) as shown in FIG. 13. On the other hand, when multi-feed is being detected, the control unit 18*a* controls the separation board drive unit 17 to rotate the separation board 13 toward a + direction rising on the pickup roller 12*b* (the paper P) side (see the separation board 13(+)).

Note that the separation pressure and the separation angle of the separation board 13 as the paper feed settings are examples of position settings of the external paper feeding unit 10.

Figure 10:
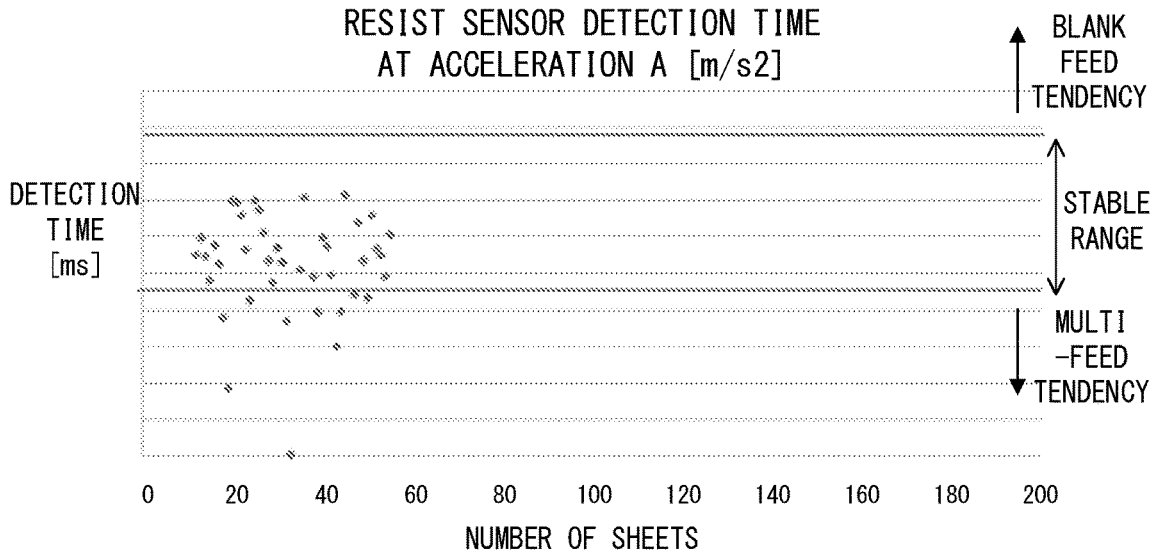
FIG. 10 is a first chart for describing detection time corresponding to acceleration according to the embodiment.
Figure 11:
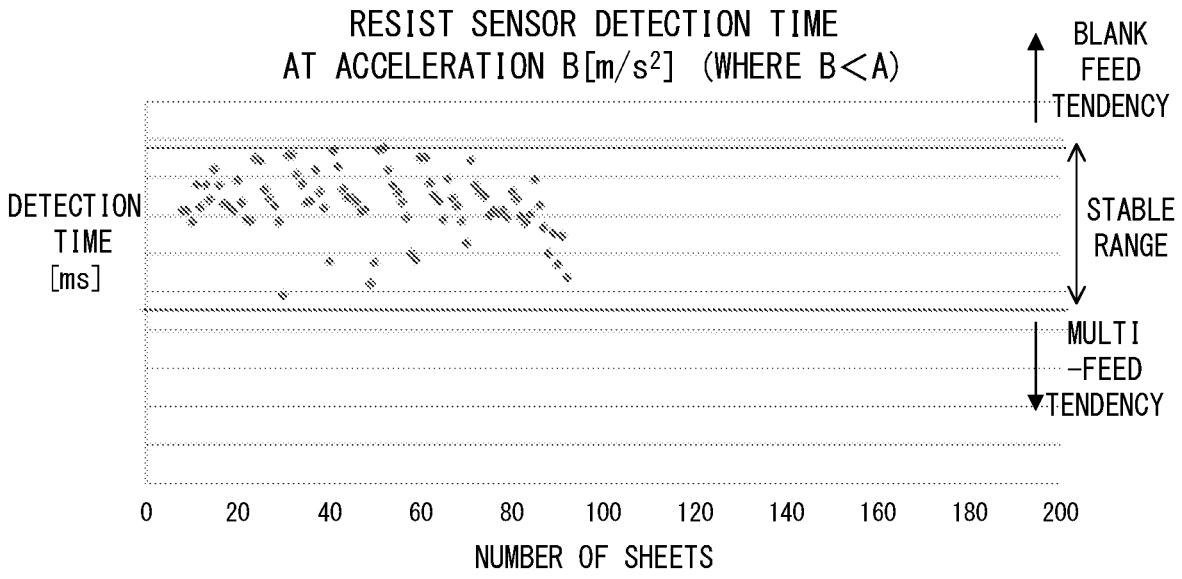
FIG. 11 is a second chart for describing detection time corresponding to acceleration according to the embodiment.

Incidentally, in regards to the paper feed acceleration at the start of paper feed of the external paper feeding unit 10, detection time [ms] from the start of paper feed of the external paper feeding unit 10 to detection of the resist sensor S in the case of acceleration A [$m/s^2$] shown in FIG. 10 is faster than that within a stable range in some of the paper P between about tenth to about fifty-fifth sheets of the paper P among the sheets of paper P to be conveyed. Thus, the paper P can be considered to be in a multi-feed tendency. On the other hand, when the acceleration A [$m/s^2$] is reduced to acceleration B [$m/s^2$], as shown in FIG. 11, the detection time becomes longer in about seventh to about ninety-fifth sheets of the paper P among the sheets of paper P to be conveyed, and falls within the stable range. As described, it is considered that the larger the acceleration, the shorter the detection time, and that the smaller the acceleration, the longer the detection time.

Therefore, when the paper feed acceleration is to be changed, the control unit 18*a* controls the feed drive unit 15 to increase the paper feed acceleration when blank feed (blank feed tendency) is being detected, and to reduce the acceleration when multi-feed (multi-feed tendency) is being detected, as shown in FIG. 9.

Similarly, as for deceleration of the external paper feeding unit 10 when abutting the paper P against the resist roller pair 31, the control unit 18*a* also controls the feed drive unit 15 to increase the deceleration acceleration (accelerate) when blank feed is being detected, and to reduce the deceleration when multi-feed is being detected.

Furthermore, when the paper feed start timing is to be changed, the control unit 18*a* controls the feed drive unit 15 to advance the paper feed start timing when blank feed is being detected, and to delay the paper feed start timing when multi-feed is being detected.

Moreover, when the slack amount is to be changed, the control unit 18*a* controls the feed drive unit 15 to increase the amount of slack formed by the paper P abutting against the resist roller pair 31 (that is, increase the conveyance amount that is the drive amount of the paper feed roller 12 for conveying a single sheet of paper P) when blank feed is being detected, and to decrease the slack amount (decrease the conveyance amount) when multi-feed is being detected.

Moreover, when the paper feed speed is to be changed, the control unit 18*a* controls the feed drive unit 15 to increase the paper feed speed when blank feed is being detected, and to slow the paper feed speed when multi-feed is being detected.

Furthermore, when the paper upper limit position is to be changed, the control unit 18*a* controls the lift drive unit 16 to lift up the paper feed tray 11 (the uppermost paper P loaded on the paper feed tray 11) when blank feed is being detected, and to lift down the paper feed tray 11 when multi-feed is being detected. As an example, in a case where an upper-limit detection sensor, not shown, detects the position of the scraper roller 12*a* that moves upward by being pushed by the paper P on the paper feed tray 11, the control unit 18*a* controls the lift drive unit 16 to stop lifting up the paper feed tray 11. However, for lifting up the paper feed tray 11, the control unit 18*a* may increase the lift-up amount of the paper feed tray 11 after the detection of the upper-limit detection sensor and, for lifting down the paper feed tray 11, may decrease the lift-up amount of the paper feed tray 11 after the detection of the upper-limit detection sensor.

The height of the paper feed tray 11 and the scraper roller 12*a* (the paper feed roller 12) as the paper feed setting is an example of the position settings of the external paper feeding unit 10, like the separation pressure and the separation angle of the separation board 13 described above. It may be considered that the position settings are changed, by notifying the changed position settings to the user by the control unit 18*a* by displaying so using a display unit, not shown, or by outputting a voice using a voice output unit, not shown.

Note that the priorities (1) to (8) of the paper feed settings shown in FIG. 9 may be set individually for a case of blank feed and for a case of multi-feed. Alternatively, the priorities (1) to (8) of the paper feed settings shown in FIG. 9 may be set for each of the paper types (an example of medium types) such as the thickness, size, and material of the paper P. For example, the control unit 18*a* may record the paper types and the use state (the number of sheets to be printed, the number of use times of each member, and the like) of the external paper feeding unit 10 (the print device 1) at the time of changing the paper feed settings, or the like, and may return the priorities of the paper feed settings to the initial values when the paper types and members are changed. Furthermore, in accordance with the paper types, the extent of changing each of the paper feed settings may be increased or reduced.

Furthermore, for example, when the paper feed acceleration and the paper feed deceleration are reduced too much, the paper feed start timing is set to be delayed too much, or the paper feed speed is set too slow, the conveyance start time of the resist roller pair 31 is delayed or the resist roller pair 31 starts conveyance without the paper P reaching the resist roller pair 31, which results in causing a conveyance error. Therefore, the control unit 18*a* may change the paper feed settings or may switch the paper feed settings after the change such that the paper feed end time of the paper P of the external paper feeding unit 10 falls within a prescribed end period.

Next, detection examples of a blank feed state and a multi-feed state will be described by referring to FIG. 14 and FIG. 15.

The example shown in FIG. 14 is a case where the reference detection time [ms] is 50 [ms], and the detection time [ms] from the start of paper feed by the external paper feeding unit 10 to detection by the resist sensor S is 50, 50, 55, 45, 50, 50, 50, 40, 50, 50 [ms] in order from the first to tenth sheets of the paper P.

In this case, difference time that is a difference between the detection time and the reference detection time is 5 [ms] for the third sheet of paper P, −5 [ms] for the fourth sheet of paper P, −10 [ms] for the eighth sheet of paper P, and 0 [ms] for the others that are the first, second, fifth, sixth, seventh, ninth, and tenth sheets of paper P.

In the example shown in FIG. 14, when the difference time reaches a threshold value of ±5 [ms], the control unit 18*a* determines that the detection result of the resist sensor S does not satisfy the criteria, and changes the paper feed setting. For example, since the difference time of the third sheet of paper P is 5 [ms], the control unit 18*a* performs a setting change for a case of having a blank feed tendency in regards to the separation pressure of the priority (1) shown in FIG. 9, from the following paper P (the fourth sheet of paper P) of the third sheet of paper P.

Thereafter, the difference time of the fourth sheet of paper P with the changed paper feed setting returns again to be −5 [ms]. Thus, the control unit 18*a* returns the changed separation pressure to the original standard setting from the fifth sheet of paper P, for example, and performs a setting change for a case of having a multi-feed tendency in regards to the separation angle of the priority (2).

Furthermore, the difference time of the eighth sheet of paper P with the changed paper feed setting comes to be −10 [ms]. Thus, the control unit 18*a* returns the changed separation angle to the original standard setting from the ninth sheet of paper P, for example, and performs a setting change for a case of having a multi-feed tendency in regards to the paper feed acceleration of the priority (3).

Next, the example shown in FIG. 15 is a case where the reference detection time [ms] is 50 [ms], and the detection time [ms] from the start of paper feed by the external paper feeding unit 10 to detection by the resist sensor S is 50, 52, 56, 57, 58, 52, 56, 52, 50, 51 [ms] in order from the first to tenth sheets of the paper P.

In this case, the difference time that is a difference between the detection time and the reference detection time is 0, 2, 6, 7, 8, 2, 7, 2, 0, 1 [ms] in order from the first to tenth sheets of the paper P.

In the example shown in FIG. 15, when the number of times the difference time reaches the threshold value of ±5 [ms] reaches four times (an example of specified number of times), the control unit 18*a* determines that the detection result of the resist sensor S does not satisfy the criteria, and changes the paper feed setting. For example, since the difference time reaches ±5 [ms] or more with the third, fourth, fifth, and seventh sheets of paper P, the control unit 18*a* performs a setting change for a case of having a blank feed tendency in regards to the separation pressure of the priority (1) shown in FIG. 9, from the following paper P (the eighth sheet of paper P) of the seventh sheet of paper P.

In the case of FIG. 15, the difference time in multi-feed does not take a minus value. However, when a case where the difference time in multi-feed is +5 [ms] or more and a case where a minus value of the difference time in blank feed is 5 [ms] or more continue in order, the control unit 18*a* may change the paper feed setting when the number of times reaching the threshold value in blank feed or multi-feed alone reaches the specified number.

Alternatively, the control unit 18*a* may change the paper feed setting based on the sum or the mean value of the difference time of the past three sheets (an example of the specified number of sheets) of the paper P having reached the threshold value, for example.

Next, changing of the paper feed settings will be described by referring to FIG. 16 to FIG. 19.

In examples shown in FIG. 16 to FIG. 19, when the difference time reaches a first threshold value (an example of a first criterion) of ±15 [ms](shown with a dotted line), the control unit 18*a* determines that the detection result of the resist sensor S does not satisfy the criteria, and changes the paper feed setting. Then, when the difference time reaches a second threshold value (an example of a second criterion) of ±20 [ms](shown with a thick dotted line), the control unit 18*a* determines that there is a multi-feed error or a blank feed error, and controls the feed drive unit 15 to stop feeding the paper. The first threshold value is a value for determining whether there is blank feed or multi-feed occurring to an extent not causing a paper feed error (feed error) (that is, having a blank feed tendency or multi-feed tendency), and the second threshold value is a value for determining whether the detection result of the resist sensor S indicates a paper feed error (feed error) When the detection result of the resist sensor S reaches the second threshold value, the user may perform paper jam clearance or the like if a multi-feed error is occurring, and the external paper feeding unit 10 may retry to feed the paper again if a blank feed error is occurring, for example. Furthermore, even in a case where the difference time reaches the second threshold value of ±20 [ms] and paper feed is to be stopped, the control unit 18*a* changes the paper feed setting for the following paper P, as in the case of reaching the first threshold value.

When the paper feed setting is changed and the difference time with the changed paper feed setting reaches the first threshold value or the second threshold value again, the control unit 18*a* switches the paper feed setting to be changed. Note that the extent of changing the paper feed setting may be set greater for a case where the difference time reaches the second threshold value than a case where the difference time reaches the first threshold value (for example, in the case of paper feed acceleration, the acceleration may be increased more or decreased more for the case where the difference time reaches the second threshold value than the case where it reaches the first threshold value).

Figure 16:
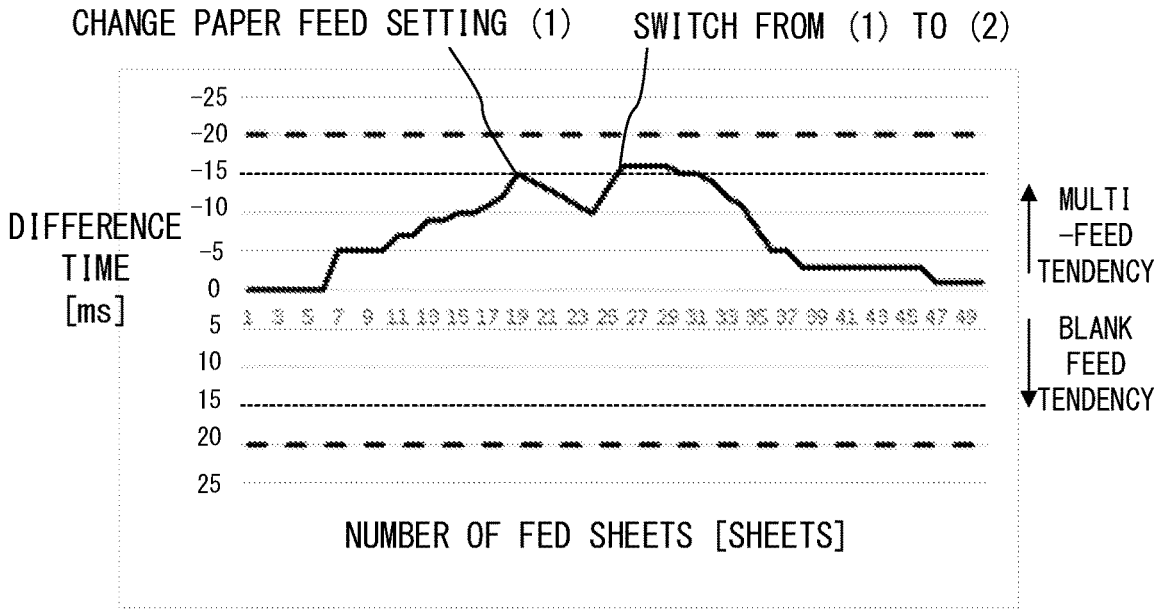
FIG. 16 is a first chart for describing a change in the paper feed setting according to the embodiment.

As for the difference time [ms] of the first to fiftieth sheets of the paper P shown in FIG. 16, the difference time of the nineteenth sheet of the paper P reaches −15 [ms] of the first threshold value. Therefore, since the multi-feed tendency is being detected, the control unit 18*a* changes the separation pressure of the priority (1) in the paper feed settings shown in FIG. 9 to be higher.

Thereafter, the difference time of the twenty-sixth sheet of the paper P with the changed paper feed setting reaches −15 [ms] of the first threshold value again, so that the control unit 18*a* returns the separation pressure of the priority (1) of the paper feed settings shown in FIG. 9 to the original setting, and switches the paper feed setting to be changed to the separation angle of the priority (2) (to + direction since the multi-feed tendency is being detected).

After the paper feed setting to be changed is switched to the separation angle of the priority (2), the difference time of the paper P does not reach ±15 [ms] of the first threshold value or ±20 [ms] of the second threshold value anew. Therefore, the control unit 18*a* may change the priority (2) of the separation angle that is the latest changed paper feed setting to (1) based on the difference time of the paper P with the changed paper feed setting not reaching the first threshold value or the second threshold value (an example of a change in the detection result of the resist sensor S with the changed paper feed setting). In this case, the priority (1) of the separation pressure in the paper feed settings may be moved down to (2).

Figure 17:
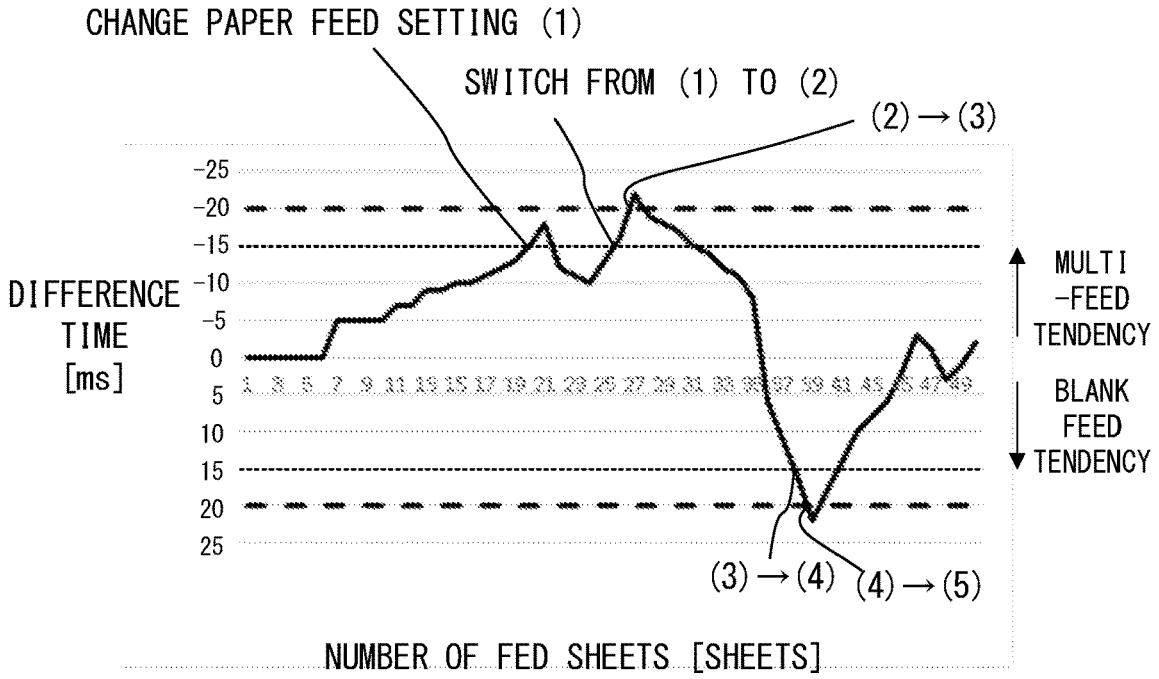
FIG. 17 is a second chart for describing a change in the paper feed setting according to the embodiment.

As for the difference time [ms] of the first to fiftieth sheets of the paper P shown in FIG. 17, the difference time of the twentieth sheet of the paper P reaches −15 [ms] of the first threshold value. Therefore, since the multi-feed tendency is being detected, the control unit 18*a* changes the separation pressure of the priority (1) in the paper feed settings shown in FIG. 9 to be higher.

Thereafter, as in the case shown in FIG. 16, the difference time of the twenty-sixth sheet of the paper P with the changed paper feed setting reaches −15 [ms] of the first threshold value again, so that the control unit 18*a* returns the separation pressure of the priority (1) of the paper feed settings shown in FIG. 9 to the original setting, and switches the paper feed setting to be changed to the separation angle of the priority (2) (to + direction since the multi-feed tendency is being detected).

Then, the difference time of the twenty-seventh sheet of the paper P with the separation angle of the priority (2) being changed reaches −20 [ms] of the second threshold value, so that the control unit 18*a* determines that there is a multi-feed error as described above, and controls the feed drive unit 15 to stop feeding the paper. Furthermore, the control unit 18*a* notifies the user to clear the paper jam. When the multi-feed error is cleared, the control unit 18*a* returns the separation angle of the priority (2) in the paper feed settings shown in FIG. 9 to the original setting, switches the paper feed setting to be changed to the paper feed acceleration of the priority (3) (deceleration since the multi-feed is being detected), and restarts printing.

After that, the difference time reaches −15 [ms] of the first threshold value for a while after the paper feed acceleration is changed. However, within a specified period after changing or switching the paper feed setting, the paper feed setting to be changed may not need to be switched as long as the difference time does not reach the first threshold value or the second threshold value anew.

Thereafter, the difference time of the thirty-eighth sheet of the paper P with the paper feed acceleration of the priority (3) being changed reaches 15 [ms] of the first threshold value, so that the control unit 18*a* returns the paper feed acceleration of the priority (3) of the paper feed settings shown in FIG. 9 to the original setting, and switches the paper feed setting to be changed to the paper feed deceleration of the priority (4) (acceleration since the blank feed tendency is being detected).

Furthermore, the difference time of the thirty-ninth sheet of the paper P with the paper feed deceleration of the priority (4) being changed reaches 20 [ms] of the second threshold value, so that the control unit 18*a* determines that there is a blank feed error as described above, and controls the feed drive unit 15 to stop feeding the paper and perform a retry. Furthermore, when the blank feed error is cleared by a successful retry or the like, the control unit 18*a* returns the paper feed deceleration of the priority (4) in the paper feed settings shown in FIG. 9 to the original setting, switches the paper feed setting to be changed to the paper start timing of the priority (5) (advanced since the blank feed is being detected), and restarts printing.

After the paper feed setting to be changed is switched to the paper feed start timing of the priority (5), the difference time of the paper P does not reach ±15 [ms] of the first threshold value or ±20 [ms] of the second threshold value anew. Therefore, the control unit 18*a* may change the priority (5) of the paper feed start timing in the paper feed settings to (1) based on the difference time of the paper P with the changed paper feed setting not reaching the first threshold value or the second threshold value (an example of a change in the detection result of the resist sensor S with the changed paper feed setting). In this case, the priorities (1) to (4) of the original paper feed settings may be moved down to (2) to (5).

Figure 18:
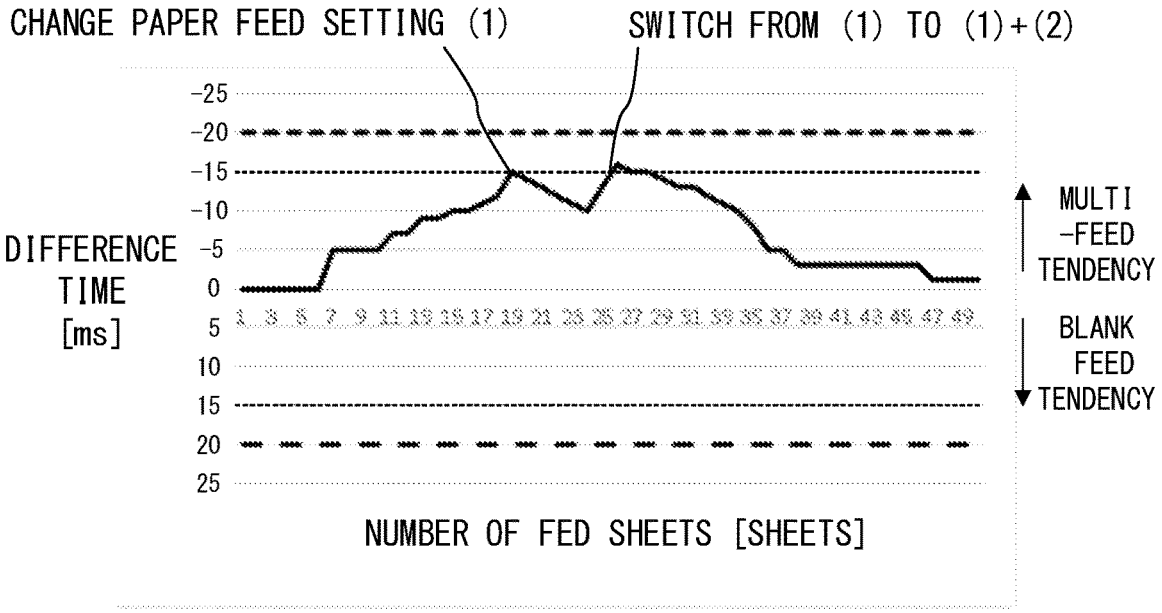
FIG. 18 is a first chart for describing changes in a plurality of paper feed settings according to the embodiment.

As for the difference time [ms] of the first to fiftieth sheets of the paper P shown in FIG. 18, the difference time of the nineteenth sheet of the paper P reaches −15 [ms] of the first threshold value. Therefore, since the multi-feed tendency is being detected, the control unit 18*a* changes the separation pressure of the priority (1) in the paper feed settings shown in FIG. 9 to be higher.

Thereafter, the difference time of the twenty-sixth sheet of the paper P with the changed paper feed setting reaches −15 [ms] of the first threshold value again, so that, in addition to the separation pressure of the priority (1) of the paper feed settings shown in FIG. 9, the control unit 18*a* also changes the separation angle of the priority (2) (+ direction since the multi-feed tendency is being detected). As described, in the case shown in FIG. 18, the control unit 18*a* changes a plurality of paper feed settings simultaneously. As for the priorities when changing a plurality of paper feed settings simultaneously, the settings may be changed according to specified orders such as, although presented simply as examples, the orders of (1), (1) and (2), (1) and (3), . . . , (1) and the last order (8), (2), (2) and (3), (2) and (4), . . . , or (1), (1) and (2), (1) and (3), (2) and (3), (2) and (4), (3) and (5), . . . , and the like. Furthermore, switching priorities may be set for the combinations of a plurality of paper feed settings. Moreover, there may be three or more paper feed settings that are changes simultaneously.

After the paper feed setting to be changed is switched to the separation pressure of the priority (1) and the separation angle of the priority (2), the difference time of the paper P does not reach ±15 [ms] of the first threshold value or ±20 [ms] of the second threshold value anew. Therefore, the control unit 18*a* may change the priority (2) in the paper feed settings, or the priority of the combination of the priorities (1) and (2) in the paper feed settings to the highest priority based on the difference time of the paper P with the changed paper feed settings not reaching the first threshold value or the second threshold value (an example of a change in the detection result of the resist sensor S with the changed paper feed settings).

Figure 19:
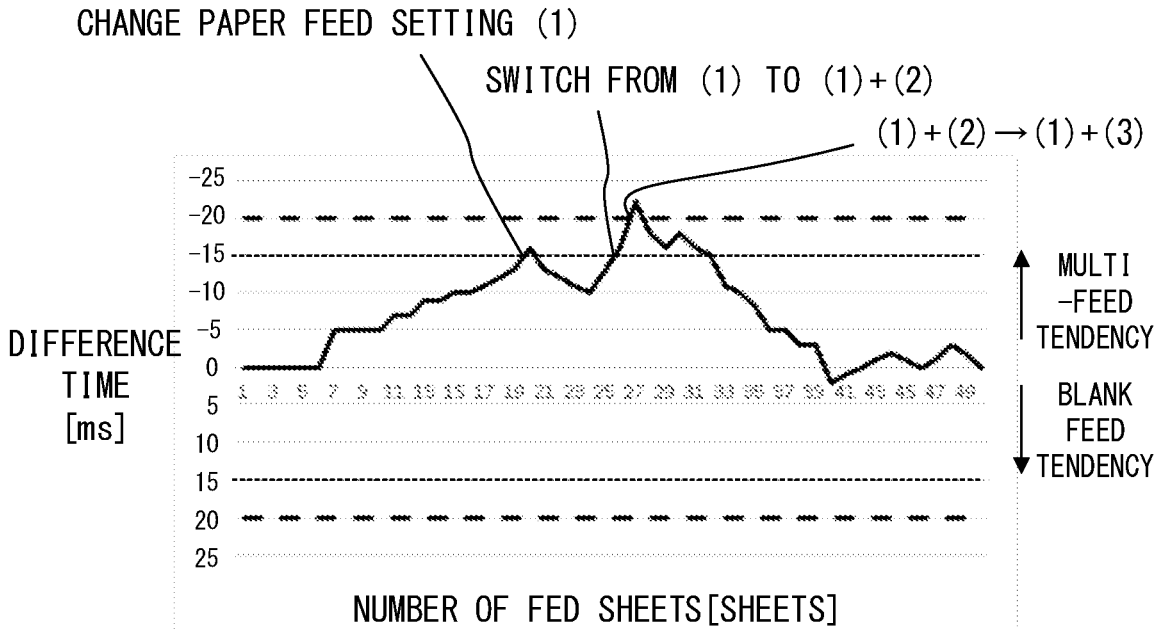
FIG. 19 is a second chart for describing changes in a plurality of paper feed settings according to the embodiment.

As for the difference time [ms] of the first to fiftieth sheets of the paper P shown in FIG. 19, the difference time of the twentieth sheet of the paper P reaches −15 [ms] of the first threshold value. Therefore, since the multi-feed is being detected, the control unit 18*a* changes the separation pressure of the priority (1) in the paper feed settings shown in FIG. 9 to be higher.

Thereafter, the difference time of the twenty-sixth sheet of the paper P with the changed paper feed setting reaches −15 [ms] of the first threshold value again, so that, in addition to the separation pressure of the priority (1) of the paper feed settings shown in FIG. 9, the control unit 18*a* also changes the separation angle of the priority (2) (+ direction since the multi-feed tendency is being detected). As described, in the case shown in FIG. 19, the control unit 18*a* also changes a plurality of paper feed settings simultaneously.

Then, the difference time of the twenty-seventh sheet of the paper P with the separation pressure of the priority (1) and the separation angle of the priority (2) being changed reaches −20 [ms] of the second threshold value, so that the control unit 18*a* determines that there is a multi-feed error as described above, and controls the feed drive unit 15 to stop feeding the paper. Furthermore, the control unit 18*a* notifies the user to clear the paper jam. When the multi-feed error is cleared, the control unit 18*a* returns the separation angle of the priority (2) in the paper feed settings shown in FIG. 9 to the original setting, switches the paper feed settings to be changed to the separation pressure of the priority (1) and the paper feed acceleration of the priority (3) (deceleration since the multi-feed is being detected), and restarts printing.

After the paper feed settings to be changed are switched to the separation pressure of the priority (1) and the paper feed acceleration of the priority (3), the difference time of the paper P does not reach ±15 [ms] of the first threshold value or ±20 [ms] of the second threshold value anew. Therefore, the control unit 18*a* may change the priority (3) in the paper feed settings or the priority of the combination of the priorities (1) and (2) in the paper feed settings to the highest priority based on the difference time of the paper P with the changed paper feed settings not reaching the first threshold value or the second threshold value (an example of a change in the detection result of the resist sensor S with the changed paper feed settings).

In the embodiment described above, the control unit 18*a* determines that the detection result of the resist sensor S does not satisfy the criteria (multi-feed or blank feed is occurring) based on the difference between the detection time from the start of paper feed by the external paper feeding unit 10 to the detection by the resist sensor S and the reference detection time having reached the threshold value, and performs a change in the paper feed settings and switching of the paper feed settings to be changed. However, the control unit 18*a* may acquire the time interval at which the paper P is detected by the resist sensor S, for example, determine that the time interval (detection result) does not satisfy the criteria (for example, the first criterion and the second criterion described above) (multi-feed or blank feed is occurring), and perform a change in the paper feed settings and switching of the paper feed settings to be changed.

Furthermore, for example, when a transmission sensor that detects a transmission amount of detection light through the paper P is used as a medium detection sensor such as the above-described resist sensor S, the control unit 18*a* may determine that the criteria (for example, the first criterion and the second criterion described above) is not satisfied (multi-feed or blank feed is occurring) based on the transmission amount as the detection result of the transmission sensor, and perform a change in the paper feed settings and switching of the paper feed settings to be changed.

Furthermore, in the embodiment described above, the control unit 18*a* switches the paper feed settings to be changed in order of the priorities (1) to (8) shown in FIG. 9. The timing for changing the paper feed setting and the timing for switching the paper feed setting to be changed may be determined by the external paper feeding unit 10, the print device 1, or a paper feed setting changing model of a learning unit disposed in an external device. In that case, the control unit 18*a* acquires information on the timing for changing the paper feed setting and the timing for switching the paper feed setting to be changed determined by the paper feed setting changing model, and performs a change in the paper feed setting and switching of the paper feed setting to be changed based on the information. For example, the control unit 18*a* may transmit, to the learning unit, the paper feed setting and the above-described detection time corresponding to the paper feed setting, and the learning unit may perform learning based on the paper feed setting and the above-described detection time corresponding to the paper feed setting by performing deep learning that extracts features by a machine itself or with the features necessary for determining the changing timing and switching timing of the paper feed settings given by a human in advance, for example.

In the embodiment described above, the medium feeding device includes: the external paper feeding unit 10 (each of the units except for the control unit 18*a*, the storage unit 18*b*, and the interface unit 18*c*) as an example of a feeding unit; the resist sensor S as an example of a medium detection sensor; and the control unit 18*a*. The external paper feeding unit 10 feeds the paper P that is an example of media. The resist sensor S detects the paper P fed by the external paper feeding unit 10. The control unit 18*a* changes the paper feed setting (an example of a feed setting) of the external paper feeding unit 10 based on the detection result of the resist sensor S. Furthermore, the control unit 18*a* switches the paper feed setting to be changed among a plurality of paper feed settings of the external paper feeding unit 10 based on the detection result of the resist sensor S.

Thereby, the control unit 18*a* can determine that multi-feed or blank feed is occurring based on the detection result of the resist sensor S, for example, and change the paper feed setting to solve the multi-feed or blank feed. Furthermore, since the control unit 18*a* switches the paper feed setting to be changed based on the detection result of the resist sensor S, in a case where the multi-feed or blank feed cannot be decreased even when the paper feed setting is changed, the flexibility of changing the settings can be improved by changing the other paper feed settings, thereby making it easier to reduce occurrence of the multi-feed or blank feed. Therefore, with the embodiment, occurrence of multi-feed and blank feed can be reduced.

However, if the deceleration amount of the paper feed acceleration is continued to be increased because multi-feed cannot be solved even when the paper feed acceleration as one of the paper feed settings is decelerated, for example, the conveyance start time of the resist roller pair 31 is delayed or the resist roller pair 31 starts conveyance without the paper P reaching the resist roller pair 31, which results in causing a conveyance error. In this case, the paper feed efficiency is deteriorated. On the other hand, the control unit 18*a* according to the embodiment switches the paper feed setting to be changed when multi-feed and blank feed cannot be solved, based on the detection result of the resist sensor S. Thus, the paper feed end time of the paper P performed by the external paper feeding unit 10 is likely to fall within a prescribed end period, thereby making it possible to avoid deterioration in the paper feed efficiency.

Furthermore, in the embodiment, when the detection result of the resist sensor S does not satisfy the criteria, the control unit 18*a* changes a part of a plurality of paper feed settings of the external paper feeding unit 10. Thereafter, when the detection result of the resist sensor S with the paper feed setting being changed does not satisfy the criteria, the control unit 18*a* switches the paper feed setting to be changed among the plurality of paper feed settings.

This makes it possible to change the paper feed setting and switch the paper feed setting to be changed such that the detection result of the resist sensor S satisfies the criteria with which multi-feed and blank feed are not likely to occur. Therefore, occurrence of multi-feed and blank feed can be reduced still further.

Furthermore, in the embodiment, when the detection result of the resist sensor S satisfies the first threshold value (an example of a first criterion) before reaching the second threshold value (an example of a second criterion) for determining that there is a paper feed error (feed error), the control unit 18*a* switches the paper feed setting to be changed among the plurality of paper feed settings. However, when it turns out as a paper feed error based on the detection result of the resist sensor S and a paper feed retry of the paper P in a blank feed state, a paper jam clearance after stopping paper feed of the paper P in a multi-feed state, or the like is to be performed, for example, the paper feed efficiency is deteriorated. On the other hand, as in the embodiment, by switching the paper feed setting to be changed at the point where it reaches the first threshold value before reaching the second threshold value for determining that the detection result of the resist sensor S indicates a paper feed error, it is possible to prevent a paper feed error from occurring. This makes it possible to reduce occurrence of multi-feed and blank feed, and also to prevent deterioration in the paper feed efficiency caused due to occurrence of the paper feed error.

Furthermore, in the embodiment, the control unit 18*a* sets the priorities for switching the plurality of paper feed settings, and changes the priorities based on the changes in the detection result of the resist sensor S while the paper feed setting is being changed. In this manner, by setting the higher priorities for the paper feed settings with which multi-feed and blank feed are not likely to occur, occurrence of multi-feed and blank feed can be reduced still further.

Furthermore, in the embodiment, the control unit 18*a* simultaneously changes a plurality of paper feed settings among the plurality of paper feed settings of the external paper feeding unit 10. Thereby, the flexibility of changing the settings for reducing multi-feed or blank feed is improved further, so that occurrence of multi-feed and blank feed can be reduced still further.

In the embodiment, the detection result of the resist sensor S is the detection time from the start of feeding the paper P by the external paper feeding unit 10 to detection of the paper P by the resist sensor S, and the control unit 18*a* switches the paper feed settings to be changed among a plurality of paper feed settings of the external paper feeding unit 10 based on the difference between the detection time of the resist sensor S and the reference detection time having reached the threshold value. This makes it possible to securely determine the occurrence state of multi-feed or blank feed based on the detection time and the reference detection time. Thus, it is possible to adequately switch the paper feed settings to be changed in accordance with the occurrence state of multi-feed or blank feed. Therefore, occurrence of multi-feed and blank feed can be reduced still further.

Furthermore, in the embodiment, the medium feeding device includes: the external paper feeding unit 10 (each of the units except for the control unit 18*a*, the storage unit 18*b*, and the interface unit 18*c*) as an example of the feeding unit; the resist sensor S as an example of the medium detection sensor; and the control unit 18*a*. The external paper feeding unit 10 feeds the paper P that is an example of the media. The resist sensor S detects the paper P fed by the external paper feeding unit 10. The control unit 18*a* changes the paper feed setting (an example of the feed setting) of the external paper feeding unit 10 based on the detection result of the resist sensor S. The paper feed setting includes, in the external paper feeding unit 10, the position setting of at least one selected from the paper feed tray 11 (an example of the tray) where the paper is loaded, the paper feed roller 12 (an example of the feed member) that sends out the paper P loaded on the paper feed tray 11, and the separation board 13 (an example of the separation member) that separates the paper P by sandwiching it with the paper feed roller 12 (the pickup roller 12*b*). The control unit 18*a* changes the position setting of the external paper feeding unit 10 based on the detection result of the resist sensor S.

Thereby, the control unit 18*a* can determine that multi-feed or blank feed is occurring based on the detection result of the resist sensor S, for example, and change the paper feed settings to solve the multi-feed or blank feed. Furthermore, since the control unit 18*a* changes the position setting of the external paper feeding unit 10 based on the detection result of the resist sensor S, the spaces and the like between the paper P and each of the members (the paper feed roller 12, the separation board 13, or the like) fluctuate and it becomes easier to decrease the multi-feed or blank feed. Therefore, occurrence of multi-feed and blank feed can be reduced.

Note that the present invention is not limited to the embodiment described above as it is, and can be embodied by modifying structural elements without departing from the scope thereof at the implementation stage. Furthermore, it is possible to form various inventions by combining, as appropriate, a plurality of structural elements disclosed in the embodiments described above. For example, the entire structural elements discussed in the embodiment may be combined as appropriate. It is needless to say that various modifications and applications are possible within the scope of the present invention.

In one aspect, a medium feeding device including:

a feeder that feeds a medium;

a medium detection sensor that detects the medium fed by the feeder; and a processor that changes feed settings of the feeder based on a detection result of the medium detection sensor, in which the processor switches a feed setting to be changed among a plurality of the feed settings of the feeder based on the detection result of the medium detection sensor.

In one other aspect, in which the processor changes a part of the plurality of feed settings of the feeder, when the detection result of the medium detection sensor does not satisfy a criterion; and, thereafter, when a detection result of the medium detection sensor with the feed setting being changed does not satisfy the criterion, switches a feed setting to be changed among the plurality of feed settings.

In one other aspect, in which the processor switches a feed setting to be changed among the plurality of feed settings, when the detection result of the medium detection sensor satisfies a first criterion that is before reaching a second criterion for determining that the detection result of the medium detection sensor indicates a feed error.

In one other aspect, in which the processor sets priorities for switching the plurality of feed settings; and changes the priorities based on a change in the detection result of the medium detection sensor while the feed setting is being changed.

In one other aspect, in which the processor simultaneously changes a plurality of feed settings among the plurality of feed settings of the feeder.

In one other aspect, in which the detection result is detection time from a start of feed of the medium by the feeder to detection of the medium by the medium detection sensor, and the processor switches a feed setting to be changed among the plurality of feed settings of the feeder based on a difference between the detection time of the medium detection sensor and a reference detection time reaching a threshold value.

In one other aspect, a medium feeding device including:

a feeder that feeds a medium;

a medium detection sensor that detects the medium fed by the feeder; and a processor that changes feed settings of the feeder based on a detection result of the medium detection sensor, in which the feed setting includes a position setting of at least one selected from, in the feeder, a tray where the medium is loaded, a feed member that sends out the medium loaded on the tray, and a separation member that separates the medium by sandwiching the medium with the feed member, and the processor changes the position setting of the feeder based on the detection result of the medium detection sensor.

What is claimed is:

1. A medium feeding device comprising:

a feeder including a tray on which a medium is loaded, a feeding roller that conveys the medium loaded on the tray, and a separation board that separates the medium from another medium loaded on the tray by sandwiching the medium with the feeding roller;

a medium detection sensor that interacts with the medium to detect the presence of the medium fed by the tray, the feeding roller, and the separation board; and a processor that sets a priority as to which one of a position setting of the separation board and a feed speed of the feeding roller will first have its feed setting changed in response to detection of the medium by the medium detection sensor at a first time, and wherein the processor changes the set feed setting priority so that one of the position setting of the separation board and the feed speed of the feeding roller will first have its feed setting changed in response to a change in the detection result of the medium detection sensor detecting the medium at a second time while the feed setting is being changed.

2. The medium feeding device according to claim 1, wherein the processor changes a part of a plurality of feed settings of the feeder, when the detection result of the medium detection sensor does not satisfy a criterion; and, thereafter, when a detection result of the medium detection sensor with the feed setting being changed does not satisfy the criterion, switches the feed setting to be changed among the plurality of feed settings.

3. The medium feeding device according to claim 1, wherein the processor switches a feed setting to be changed among a plurality of feed settings, when the detection result of the medium detection sensor satisfies a first criterion that is before reaching a second criterion for determining that the detection result of the medium detection sensor indicates a feed error.

4. The medium feeding device according to claim 1, wherein the processor simultaneously changes a plurality of feed settings of the feeder.

5. The medium feeding device according to claim 1, wherein the detection result is detection time from a start of feed of the medium by the feeder to detection of the medium by the medium detection sensor, and the processor switches a feed setting to be changed among a plurality of feed settings of the feeder based on a difference between the detection time of the medium detection sensor and a reference detection time reaching a threshold value.

6. A medium feeding device according to claim 1, wherein the processor changes feed settings of the feeder based on a detection result of the medium detection sensor, the feed settings include a position setting of at least one of the tray where the medium is loaded, the feeding roller that conveys the medium loaded on the tray, and the separation board that separates the medium from another medium by sandwiching the medium with the feeding roller, and the processor also changes the position setting of the tray, the feeding roller, and the separation board based on the detection result of the medium detection sensor.

* * * * *